US005835838A

United States Patent [19]

Yu

[11] Patent Number: 5,835,838

[45] Date of Patent: Nov. 10, 1998

[54] PHOTORECEPTOR CLEANING/ CONTAMINATION PREVENTION SYSTEM

[75] Inventor: Robert C.U. Yu, Webster, N.Y.

[73] Assignee: Xerox Corporation, Stamford, Conn.

[21] Appl. No.: 756,851

[22] Filed: Nov. 26, 1996

Related U.S. Application Data

[63] Continuation-in-part of Ser. No. 274,065, Jul. 12, 1994, Pat. No. 5,610,699.

[51] Int. Cl.[6] ..... G03G 21/00

[52] U.S. Cl. ..... 399/350; 15/256.5; 428/408; 430/125

[58] Field of Search ..... 399/350, 299; 430/490, 125; 15/256.5, 256.51; 428/408

[56] References Cited

U.S. PATENT DOCUMENTS

| | | | |
|---|---|---|---|
| 4,264,191 | 4/1981 | Gerbasi et al. | 355/15 |
| 4,563,408 | 1/1986 | Lin et al. | 430/59 |
| 4,585,322 | 4/1986 | Reale | 355/3 CH |
| 4,585,323 | 4/1986 | Ewing et al. | 355/3 CH |
| 4,666,966 | 5/1987 | Fujimoto et al. | 524/114 |
| 4,823,161 | 4/1989 | Yamada et al. | 355/15 |
| 4,835,807 | 6/1989 | Swift | 15/1.5 R |
| 4,864,331 | 9/1989 | Boyer et al. | 346/159 |
| 4,875,081 | 10/1989 | Goffe et al. | 355/303 |
| 5,138,395 | 8/1992 | Lindblad et al. | 355/299 |
| 5,153,657 | 10/1992 | Yu et al. | 355/299 |
| 5,208,639 | 5/1993 | Thayer et al. | 355/299 |
| 5,264,903 | 11/1993 | Nagame et al. | 355/297 |

FOREIGN PATENT DOCUMENTS

| | | |
|---|---|---|
| 58-74735 | 5/1983 | Japan . |
| 2-176690 | 7/1990 | Japan . |
| 4-73677 | 3/1992 | Japan . |
| 5-210338 | 8/1993 | Japan . |

*Primary Examiner*—William Royer

[57] ABSTRACT

An apparatus for cleaning a charge retentive surface of a photoreceptor which includes a cleaning blade or brush for removing debris from the charge retentive surface of a photoreceptor. In the environment of a xerographic copier and/or printer, corona effluents are emitted by the high voltage charging devices. These effluents, which are strong oxidizing/ozonating agents, may be adsorbed by or otherwise attach a cleaning blade, brush or corona-proximate polymer matrix device or housing. Thereafter, such corona species outgassing may chemically and/or otherwise attack the photoreceptor during prolonged proximate exposure or contact, resulting in print/copy defects, as well as permanent damage to the photoreceptor and/or cleaning blade, brush or other device. The apparatus for cleaning relates to impregnation or treatment with an antiozonant such that its presence in the polymer matrix can prevent corona species penetration or accumulation by chemically neutralizing and destroying the species upon exposure. Impregnation or treatment can be performed with a variety of antiozonant materials to hinder or eliminate the corona species absorption and accumulation so as to resolve corona species outgassing-related problems.

25 Claims, 3 Drawing Sheets

PHOTORECEPTOR CLEANING/ CONTAMINATION PREVENTION SYSTEM

The present application is a continuation-in-part of application Ser. No. 08/274,065 filed on Jul. 12, 1994, now U.S. Pat No. 5,610,699 entitled "Photoreceptor Cleaning Apparatus and Method".

The present invention relates to a electronic reprographic image forming apparatus, and more particularly, to a system for cleaning of residual toner and other debris from or for preventing contamination of a charge retentive belt or drum surface of an image forming or holding apparatus.

In electrophotographic applications such as xerography, a charge retentive photoreceptor belt or drum is electrostatically charged according to the image to be produced. In a digital printer, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input device such as a raster input scanner controlled by an electronic subsystem can be adapted to provide an electrostatic latent image to the photoreceptor. In a light lens copier, the photoreceptor may be exposed to a pattern of light or obtained from the original image to be reproduced. In each case, the resulting pattern of charged and discharged areas on photoreceptor form an electrostatic charge pattern (an electrostatic latent image) conforming to the original image.

The electrostatic image on the photoreceptor may be developed by contacting it with a finely divided electrostatically attractable toner. The toner is held in position on the photoreceptor image areas by the electrostatic charge on the surface. Thus, a toner image is produced in conformity with a light image of the original beam reproduced. Once each toner image is transferred to a substrate, and the image affixed thereto form a permanent record of the image to be reproduced. In the case of multicolor copiers and printers, the complexity of the image transfer process is compounded, as four or more colors of toner may be transferred to each substrate sheet. Once the single or multicolored toner is applied to the substrate, it is permanently affixed to the substrate sheet by fusing so as to create the single or multicolor copy or print.

Following the photoreceptor to substrate toner transfer process, it is necessary to at least periodically clean the charge retentive surface of the photoreceptor. In order to obtain the highest quality copy or print image, it is generally desirable to clean the photoreceptor surface each time after the toner image is transferred to a substrate or receiving member. In addition to removing excess or residual toner, other particles such as paper fibers, toner additives and other impurities (hereinafter collectively referred to as "residue") may remain on the charged surface of the photoreceptor. Cleaning blades and brushes may be employed to remove residue from a photoreceptor surface. Typical polymeric materials used for cleaning blade application include thermoplastic and thermoset polyurethane elastomers, silicones, vitons, polyphosphazines, polyvinyl chlorides, polyacrylates, polycarbonates, and the like. In practice, often time an elastomeric polyurethane blade generally employed to scrape debris residue from the photoreceptor surface. A rotating cleaning brush, however, may also be used to remove, loosen, dislodge, abrade or otherwise clean unwanted toner and other residue from the photoreceptor surface.

When using a cleaning blade of any kind of polymeric materials, an elastomeric polyurethane blade in particular may be used to clean the residue toners from the surface of an organic photoreceptor belt or drum. Corona species (emitted from the charging device and adsorbed by the blade during electrophotographic imaging process) out gassing from the blade matrix may cause a variety of problems, to include attack of the photoreceptor causing copy deletion print defects when the blade is resting on the surface of the photoreceptor. This copy print defect problem that can occur include visible inboard-outboard transverse defect lines in copies and prints corresponding to the location where the photoreceptor and blade are in contact during machine is idling. Prior art solutions have included the use of a mechanical system to retract the cleaning blade away from the photoreceptor surface when the machine is idle in order to prevent the blade and photoreceptor contact which thereby eliminating the cause of chemical effects that degrade the photoreceptor. Such blade retraction mechanisms can add costs and may create new problems. To reduce manufacturing costs, it is desirable not to use a blade retraction system, which not only can provide the cost cutting benefit but also eliminate the service and repair requirements associated with such a device. Unfortunately, eliminating such a blade retraction system can lead to copy residue spots printout problem that such systems are intended to prevent.

During xerographic imaging and cleaning processes, one can envision that the elastomeric cleaning blade can absorb and cumulatively store a substantial amount of corona species into the polymer matrix of the cleaning blade. Likewise, when intermediate transfer members (drums or belts) are used, they may also suffer from the effects of corona species. Any member proximate to or in periodic or continuous contact with an imaging member (such as a bias transfer roll, a plastic housing used for cleaning or some other purpose) may contribute to degradation of an image forming or holding member. (See, for example, the disclosures on intermediate transfer members and bias transfer members in U.S. Pat. No. 5,119,140 assigned to Xerox Corporation and incorporated by reference herein.)

The corona species themeselves may be emitted from high voltage charging devices (such as corotrons and scorotrons). The corona species absorbed by the cleaning blade can then outgas from the cleaning blade so as to chemically attack the electrically active components in the photoreceptor. This attack may be at the location where blade tip/edge and photoreceptor make prolonged intimate contact, thus causing repetitive (print defect) development of a narrow area of photoreceptor chemical damage which manifests itself as a deletion band or a solid print/copy line defect, depending on the development system employed in the copier or printer. The damage to the photoreceptor can be long lived, and may generally only be corrected by costly outright replacement of the photoreceptor and cleaning blade. In some cases, the print defect may appear after only a few thousand copies; in a machine having a photoreceptor life target of far exceeding this output, such a premature failure represents a major component life shortfall.

If the corona species chemically attack the photoreceptor during blade/photoreceptor contact or proximity, preventive measures to lessen or eliminate the corona species absorption and accumulation in the blade polymer matrix can be employed to resolve the problem. Corona effluents emitted by the high voltage charging device are strong oxidizing agents; as such, the use of an antioxidant, or more specifically, an antiozonant, can provide the blade with an added capability of being able to perform the functions of corona scavenging, by neutralizing the corona species.

Various approaches have been employed to deal with problems associated with cleaning and photoreceptor oxidation in copying or printing machine environments; including the following disclosures that may be relevant:

U.S. Pat. No. 5,264,903

Patentee: Nagame et al.

Issued: Nov. 23, 1993

U.S. Pat. No. 5,208,639

Patentee: Thayer et al.

Issued: May 4, 1993

U.S. Pat. No. 5,153,657

Patentee: Yu et al.

Issued: Oct. 6, 1992

U.S. Pat. No. 5,138,395

Patentee: Lindblad et al.

Issued Aug. 11, 1992

U.S. Pat. No. 4,875,081

Patentee: Goffe et al.

Issued: Oct. 17, 1989

U.S. Pat. No. 4,864,331

Patentee: Boyer et al.

Issued: Sep. 5, 1989

U.S. Pat. No. 4,835,807

Patentee: Swift

Issued: Jun. 6, 1989

U.S. Pat. No. 4,823,161

Patentee: Yamada et al.

Issued: Apr. 18, 1989

U.S. Pat. No. 4,585,323

Patentee: Ewing et al.

Issued: Apr. 29, 1986

U.S. Pat. No. 4,585,322

Patentee: Reale

Issued: Apr. 29, 1986

U.S. Pat. No. 4,563,408

Patentee: Lin et al.

Issued: Jan. 7, 1986

U.S. Pat. No. 4,264,191

Patentee: Gerbasi et al.

Issued: Apr. 28, 1981

JP-02-176690

Patentee: Kimura

Issued: Jul. 9, 1990

JP-04-73677

Patentee: Nagame et al.

Issued: Mar. 9, 1992

JP-02-210338

Patentee: Nagame et al.

Issued: Aug. 20, 1993

U.S. Pat. No. 5,264,903 to Nagame et al discloses a cleaning unit for use in an image-formation formation apparatus including a photoconductor, provided with a cleaning member which can be brought into contact with the surface of the photoconductor and is made of an activated carbon fiber as the main component.

U.S. Pat. No. 5,208,639 to Thayer et al discloses an apparatus for cleaning residual toner and debris from a moving charge retentive surface of an image forming apparatus. The invention includes a multiple blade holder for selectively indexing each individual blade into position for cleaning the moving photoreceptor. The blade holder contains a number of cleaning blades mounted radially from a central core; by rotating the holder about its longitudinal axis a new cleaning blade is moved by the indexing device into the cleaning position to replace a failed blade. The indexing device removes the failed cleaning blade and positions a new cleaning blade in frictional contact with the photoreceptor for cleaning.

U.S. Pat. No. 5,138,395 to Lindblad et al discloses a cleaning blade which is made from a thermoplastic material having a compounded additive for lubrication. The cleaning blade is used in an electrophotographic printing machine to remove residual particles from a photoconductive surface.

U.S. Pat. No. 5,153,657 to Yu et al discloses a blade member impregnated with inorganic particulates dispersed therein so as to reinforce the blade for improving blade life.

U.S. Pat. No. 4,875,081 to Goffe et al discloses a blade member for cleaning a photoreceptor wherein an A.C. voltage is applied to the cleaning blade. Use of the A.C. voltage eliminates the need to bias the blade against the photoreceptor with a high frictional force and thus eliminates impaction of toner on the photoreceptor surface.

U.S. Pat. No. 4,864,331 to Boyer et al discloses an offset electrostatic imaging process which includes the steps: (a) forming a latent electrostatic image on a dielectric imaging member, with the dielectric imaging member being prepared by coating an electrically conductive substrate with a porous layer of a non-photoconductive metal oxide using a deposition process; (b) developing the latent electrostatic image with a developer material which comprises a silicone polymer and from about 0.5 to about 5 percent by weight of a metal salt of a fatty acid; (c) transferring the developed image to an image receiving surface by applying pressure between the dielectric imaging member and the image receiving surface; (d) cleaning the dielectric imaging member using a first cleaning means which is effective to remove developer material residue from about the surface of the porous oxide layer; and (e) further cleaning the dielectric imaging member using a second cleaning means which is effective to remove developer material residue from the pores below the surface of the oxide layer.

U.S. Pat. No. 4,835,807 to Swift discloses a cleaning brush for use in electrophotographic copying machines, printers or the like in which carbon black is suffused in the fibers of a polymer-bristled brush to enhance the conductivity of those fibers.

U.S. Pat. No. 4,823,161 to Yamada et al. discloses a cleaning blade for use in electrophotographic copying machines, facsimile machines, printers or the like which is characterized in that it has a double-layer structure and comprises a contact member made of a poly(urethane) ureamide polymer and to be held in contact with a toner image bearing member, and a support member for the contact member having the same hardness or substantially the same hardness as the contact member and lower than the contact member in glass transition temperature.

U.S. Pat. No. 4,585,323 to Ewing et al. and U.S. Pat. No. 4,585,323 to Reale disclose devices for neutralizing ozone, in which a metallic paint or film is used to prevent ozone generated by a coronode from damaging the photoreceptor of electrophotographic copying machines or printers.

U.S. Pat. No. 4,563,408 to Lin et al. discloses an electrophotographic imaging member, which includes a conductive layer, a charge transport layer comprising an aromatic amine charge transport or hydrazone molecule in a continuous polymeric binder phase, and a contiguous charge generation layer comprising a photoconductive material, a polymeric binder and a hydroxyaromatic antioxidant. An electrophotographic imaging process using this member is also described.

U.S. Pat. No. 4,264,191 to Gerbasi et al. describes a laminated doctor blade for removing excess marking material or other material from a surface. The blade comprises a relatively hard layer of a smooth tough material and a relatively soft layer of resilient material.

JP-02-176690 to Kimura discloses making electrophotographic sensitive body oxidation-resistant, to include by the use of antioxidant by providing a means for supplying the antioxidant to the surface of the sensitive body.

JP-04-73677 to Nagame et al. discloses maintaining the good quality of an image over a long time by cleaning while making a cleaning member which is mainly made of active carbon fiber always abut on a photosensitive body.

JP-05-210338 to Nagame, et al. discloses preventing image flowing caused by corona generated substance which is generated by corona discharge and to maintain a good-quality image over a long term by providing a means for applying a substance which complements the lowering of the surface resistance of a photosensitive body to the surface of the photosensitive body.

In accordance with one aspect of the present invention, there is provided a system for preventing oxidative damage to a surface. The system includes a member including at least a first portion thereof proximate to the surface and a non-carbonaceous antioxidant for neutralizing oxidizing agents present at the first portion of the member.

In accordance with another aspect of the present invention, there is provided a printing machine including a system for preventing oxidative damage to a charge retentive surface. The system includes a member including at least a first portion thereof proximate to the charge retentive surface and a non-carbonaceous antioxidant for neutralizing oxidizing agents present at the first portion of the member.

In accordance with another aspect of the present invention, there is provided a method for neutralizing oxidants on members proximate to charge-retentive surfaces in a printing system. The method includes providing a non-carbonaceous antioxidant material and treating at least a first portion of the member adjacent to the charge-retentive surface with the non-conductive antioxidant for neutralizing oxidizing agents present at the first portion of the member.

The invention will be described in detail with reference to the following drawings, in which like reference numerals are used to refer to like elements. The various aspects of the present invention will become apparent as the following description proceeds and upon reference to the drawings, in which.

Figure 1:
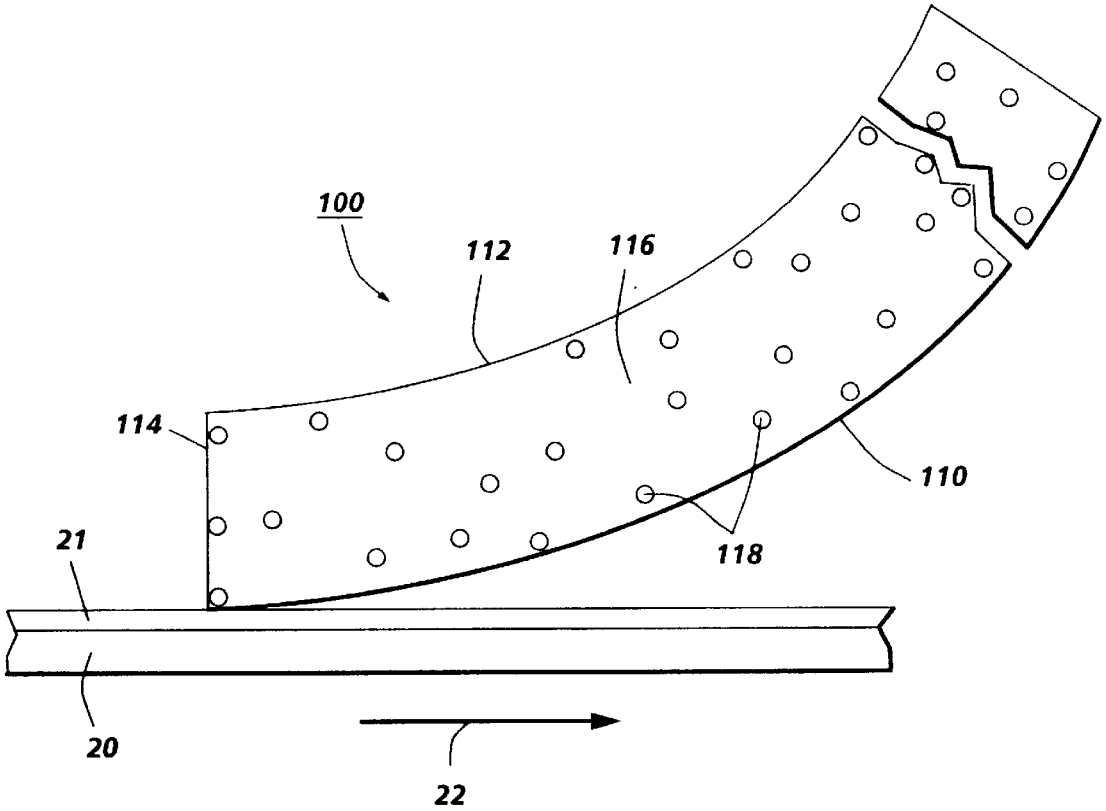
FIG. 1 is a sectional, elevational view of a cleaning blade of the present invention.

While the present invention will hereinafter be described in connection with preferred embodiments, it will be understood that it is not intended to limit the invention to a particular embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate like elements. It will become evident from the following discussion that the present invention and the various embodiments set forth herein are suited for use in a wide variety of printing and copying systems, and are not necessarily limited in its application to the particular systems shown herein.

Figure 4:
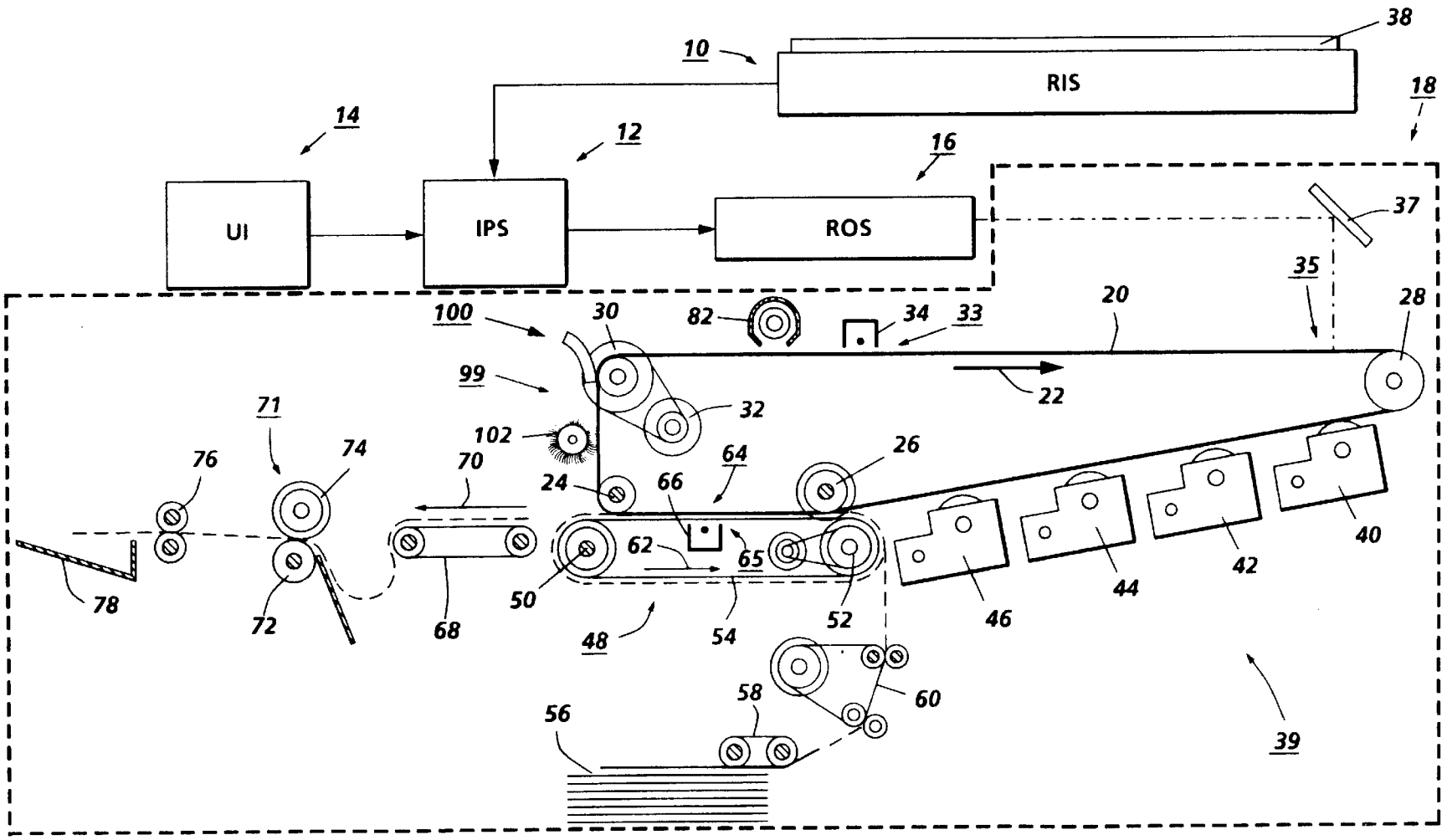
FIG. 4 is a schematic elevational view showing an exemplary electrophotographic printing machine which may incorporate the features of the present invention therein.

To begin by way of general explanation, FIG. 4 is a schematic elevational view showing an electrophotographic printing machine which may incorporate features of the present invention therein. It will become evident from the following discussion that the present invention is equally well suited for use in a wide variety of copying and printing systems, and is not necessarily limited in its application to the particular system shown herein. As shown in FIG. 4, during operation of the printing system, a multiple color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates.

The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multicolored image on the copy sheet. This multicolored image is then fused to the copy sheet forming a color copy.

With continued reference to FIG. 4, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. (In FIG. 4, each developer unit 40, 42, 44 and 46 is shown in the operative position.) During development of each electrostatic latent image, only one developer unit is in the operative position, with the remaining developer units are in the nonoperative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown in FIG. 4) extends between belts 54 and moves in unison therewith. A sheet is advanced from a stack of sheets 56 disposed on a tray. A friction retard feeder 58 advances the uppermost sheet from stack 56 onto a pre-transfer transport 60. Transport 60 advances a sheet (not shown in FIG. 3) to sheet transport 48. The sheet is advanced by transport 60 in synchronism with the movement of the sheet gripper. In this way, the leading edge of the sheet arrives at a preselected position, i.e. a loading zone, to be received by the open sheet gripper. The sheet gripper then closes securing the sheet thereto for movement therewith in a recirculating path. The leading edge of the sheet is secured releasably by the sheet gripper. As belts 54 move in the direction of arrow 62, the sheet moves into contact with the photoconductive belt, in synchronism with the toner image developed thereon. In transfer zone 64, a gas directing mechanism (not shown in FIG. 4) directs a flow of gas onto the sheet to urge the sheet toward the developed toner image on photoconductive member 20 so as to enhance contact between the sheet and the developed toner image in the transfer zone. Further, in transfer zone 64, a corona generating device 66 charges the backside of the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

Figure 3:
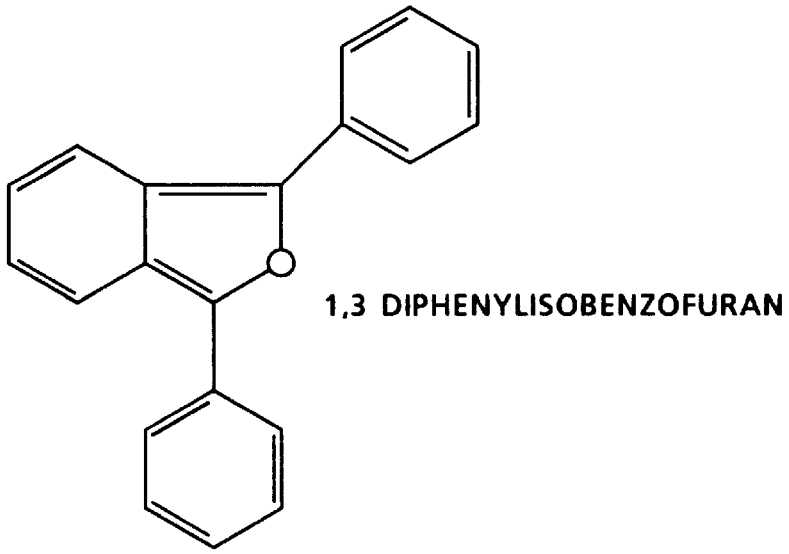
FIG. 3 is a diagram showing a molecular structure of an exemplary antioxidant agent.

The final processing station in the direction of movement of belt 20, as indicated by arrow 22, is a photoreceptor cleaning station, indicated generally by the reference numeral 99, and as partially described in greater detail in association with FIGS. 1 and 3. Cleaning blade 100 may serve as the primary or backup means of toner and debris removal. Cleaning blade 100 is shown proximate to corona generating device 34 (as well as other environmental (electrical, mechanical and/or chemical) problem sources such as are addressed by the cleaning blades of the present invention. Other aspects and embodiments of the photoreceptor cleaning blades of the present invention, such as those as shown and described in association with FIGS. 1 and 3 and the relevant Examples below, may be employed in cleaning photoreceptors. A rotatably mounted fibrous brush 102 (which may also include the oxidative contamination prevention system of the present invention) may be positioned in the cleaning station and maintained in contact with photoconductive belt 20 to preclean and remove residual toner particles remaining after the transfer operation. Thereafter, lamp 82 illuminates photoconductive belt 20 to remove any residual charge remaining thereon prior to the start of the next successive cycle.

FIG. 1 shows a photoreceptor cleaning blade 100 for removing residual toner and other debris from the charge retentive surface of layer 21 (shown in FIG. 1, on a flat portion of a belt photoreceptor 20). Cleaning blade 100 is supported adjacent to photoreceptor 20 by a mounting flange or member (not shown). Photoreceptor cleaning blade 100 of the present invention provides for the application of a desired uniformly dispersed pressure or contact force for cleaning photoreceptor 20. Photoreceptor cleaning blade 100 may be coupled with an elastomeric cleaning brush 102 as shown in FIG. 4, for removing residual toner and other debris from charge retentive layer 21. Cleaning brush 102 preferably includes a plurality of bristles, which must necessarily be constructed from a material that is softer than the charge retentive surface of photoreceptor 20 so to prevent scratching or other damage to the charge retentive surface, and which may be provided with an antioxidant or antiozonant as described below. Cleaning blade 100 and cleaning brush 102 preferably extend across the width of photoreceptor 20, so as to cooperatively remove excess matter/debris from layer 21. Cleaning blade 100 is mounted to a supporting structure (not shown) so as to be held in place as shown in FIG. 1.

Photoreceptors can comprise either a single layer or a multilayer belt structure, such as shown in FIG. 1, or a drum structure (not shown). A photoconductive layer (such as layer 21 of photoreceptor 20 in FIG. 1) may be a homogeneous layer of a single material such as vitreous selenium or may be a composite of layers containing a photoconductor. The commonly used multilayered or composite structure contains at least a photogeneration layer, a charge transport layer and a conductive substrate. The photogeneration layer generally contains a photoconductive pigment and a polymeric binder. The charge transport layer (e.g., hole transport layer) contains a polymeric binder and charge transport molecules (e.g., aromatic amines, hydrazone derivatives, etc.). These organic, low ionization potential hole transport molecules as well as the polymeric binders are very sensitive to oxidative conditions arising from photochemical, electrochemical and other chemical reactions.

In copiers and printers, cleaning blades, brushes and other devices are frequently exposed to difficult environmental conditions, to include light, charging devices such as corotrons, dicorotrons, scorotrons and the like, electric fields, oxygen, oxidants and moisture. Activated carbon and carbon black-containing (hereinafter "carbonaceous") materials, members and brushes (such as disclosed in U.S. Pat. Nos. 4,835,807, JP-04-73677 and the like) are known. Many materials contain carbon black and other carbonaceous additives; even toner includes carbon additives. The presence of these carbonaceous materials may add little or benefit in preventing oxidation and ozone contamination proximate to the photoreceptors in electrophotographic printers. Undesirable chemical oxidative species are often formed during corona charging in xerographic imaging processes which may react with key organic components in the charge transport layer or photogeneration layer of the photoreceptors. These unwanted chemical reactions can cause photoreceptor degradation, poor charge acceptance and cyclic instability. Several types of reactive chemical species that are likely to be formed in the operational environment of a copier or an electronic printer include:

(a) Oxidants (e.g., peroxides, hydroperoxides, ozone, oxygen, selenium, selenium oxide, selenium alloys, arsenic oxide, vanadium oxide, VOPs and the like) may vary depending on the type of photoreceptor used.

(b) Both organic and inorganic radicals and diradicals (e.g., R, $RO_2$; $O_2$; $NO_2$; OH; and the like).

(c) Ionic species having positive (e.g., aromatic amine+) or negative (e.g., 0−) charges.

(d) Both singlet oxygen states (i.e., $^1\mathbf{0}_2$ (Sigma$^+$g) and $^1\mathbf{0}_2$ (Δg) can form through a sensitized photooxidation mechanism.

The foregoing chemical species can be generated from chemical, electrochemical and photochemical reactions as well as from the corona discharge in air by a charging device. The oxidative intermediates and their products can degrade the photoreceptor, cleaning blades and other components. If the cleaning blade in contact with photoreceptor degrades as a result of chemical and photochemical reactions, the photoreceptor becomes conductive (e.g., develops high dark decay) and exhibits regionalized print defects, poor charge acceptance, aging and stability deficiencies. Depending on the degree of damage, the photoreceptor degradation can lead to poor image quality, cycle-up, and cycle-down problems or even an inability of a copier or an electronic printer to produce a print. Belt or drum photoreceptors, in which ions, particulates and other harmful may fall from a charging device onto or near a cleaning blade/photoreceptor interface, can present a particularly oxidizing environment.

Referring to FIGS. 1 and 4, printer/copier inboard-outboard line print defects have been identified to be caused by corona species outgassing from the cleaning blade to chemically attack the photoreceptor belt 20 (or a photoreceptor drum, not shown) at the area where cleaning blade 100 remains in contact with charge retentive layer 21 photoreceptor 20 during long period of time machine idling. This photoreceptor damage is permanent, and will require that both the photoreceptor and cleaning blade be replaced. Cleaning blade 100 includes a lower surface 110, an upper surface 112 and a lead edge 114; the intersection point of the lower surface 110 and lead edge 114 is the portion of the cleaning blade which most vigorously contacts charge retentive layer 21 of photoreceptor 20. As photoreceptor 20 moves in direction 22, residual toner and other excess debris is removed from photoreceptor 20. Polyurethane blade body material 116 of cleaning blade 100 is treated with antioxidant material 118 (shown in representative fashion in FIG. 1). To achieve satisfactory antioxidant/antiozonant impregnation results, a desirable amount of antioxidant in the cleaning blade, brush, or other member may be within the range of about 0.0001 weight percent to about 5 weight percent. In other embodiments in which, for example, mechanical properties of a blade, brush or other device are not an issue or are not affected by antioxidant/antiozonant addition, higher levels of 15% or more by weight of antioxidant/antiozonant may be quite useful if not desired.

The antioxidant(s) or antiozonant(s), examples of which are more fully described in Examples II and III below, prevent damage to cleaning blade 100 and photoreceptor 20. Cleaning blade 100 may be impregnated with, manufactured to include, or otherwise treated with antioxidant or antiozonant material/agent to combat cleaning blade and/or photoreceptor damage caused by the outgassing of corona species. Cyclic print testing results (according to the Examples to follow) have shown that the cleaning blade of the present invention can neutralize the damaging outgassing effects so as to permit the cleaning blade to reach full photoreceptor life target without the onset of print defects and/or photoreceptor damage.

The antioxidant(s) or antiozonant(s) prevent corona species from outgassing from a cleaning blade, by neutralizing those corona species. The antioxidant or antiozonant impregnated blade thus prevents chemical, electrochemical or other corona species-related attack on the photoreceptor during blade/photoreceptor contact. This preventive measure hinders or eliminates the corona species absorption and accumulation in the blade polymer matrix. Since corona effluents emitted by the high voltage charging device are strong oxidizing agents, impregnating the cleaning blade polymer matrix with an antioxidant or antiozonant can prevent corona species penetration or accumulation by chemically neutralizing and/or destroying the species upon exposure. In recapitulation, various embodiments of a photoreceptor or intermediate transfer drum/roller cleaning system employing an antioxidant impregnated/treated cleaning blade or brush which permits the removal of residual toner and debris from the charge retentive surface of a photoreceptor has been described. Likewise, the system of the present invention described in relation to cleaning blades herein can be used to prepare a variety of cleaning devices (such as polymeric cleaning brushes) or even non-cleaning related devices (such as a bias transfer rolls, housings, guide members or other devices) proximate to or in periodic or continuous contact with a photoreceptor or intermediate transfer member to prevent those devices from contibuting to corona species or other oxidative or ozone-related outgassing attacks on photoreceptor or intermediate transfer member has also been described. (See, for example, intermediate transfer belt 7, with housing 30 and bias transfer member 16 proximate/in contact therewith as shown in FIG. 1 of U.S. Pat. No. 5,119,140 assigned to Xerox Corporation and incorporated by reference herein.) This elimination of the root cause of corona species outgassing from the blade 100, brush 102 (both of FIG. 4 herein) or other device or housing proximate to the photreceptor or intermediate transfer member may be resolved by adopting the system of the present invention, as described more specifically in the blade-related Examples to follow.

As will be discussed below in one embodiment of the present invention, a specific amount of a selected antioxidant or antiozonant is dissolved in a solvent of a polymeric cleaning blade. The cleaning blade is then totally submersed in the solvent containing the antioxidant or antiozonant and allow it to swell and reach the swelling equilibrium state, a condition defined as the increase in elastic free energy due to the three-dimensional, isotropic deformation of the network is just offset by the decrease in free energy due to the mixing of polymer and solvent having the dissolved antioxidant. Thereafter, the swollen cleaning blade is removed from the solvent and allowed to dry under ambient conditions to evaporate the liquids in the solvent. The blade may then be further dried in a vacuum to eliminate any residual solvent. In that the dissolved antioxidant or antiozonant is a non volatile compound, it will remain inside the material structure, homogeneously distributed in the matrix of the blade after the solvent has evaporated. The amount of antioxidant/antiozonant distribution in the blade matrix can thus be controlled by either removing the submersed blade from the solvent at any specific condition of swelling prior to reaching the equilibrium swelling state or by otherwise controlling or limiting the amount of the antioxidant or antiozonant to be dissolved in the solvent.

In one embodiment of the present invention (also discussed later below), an antioxidant was dissolved in methylene chloride to form a dilute solution. A typical thermoset elastomeric polyurethane cleaning blade was submersed in the solution and allowed to absorbing the solution until the state of swelling equilibrium was reached. The swollen cleaning blade was then removed from the solution and allowed dry for 10 hours under room ambient condition, followed by storage under vacuum for 3 hours to further remove any residual solvent from the blade.

EXAMPLE I

(UNTREATED CLEANING BLADE)

Figure 2:
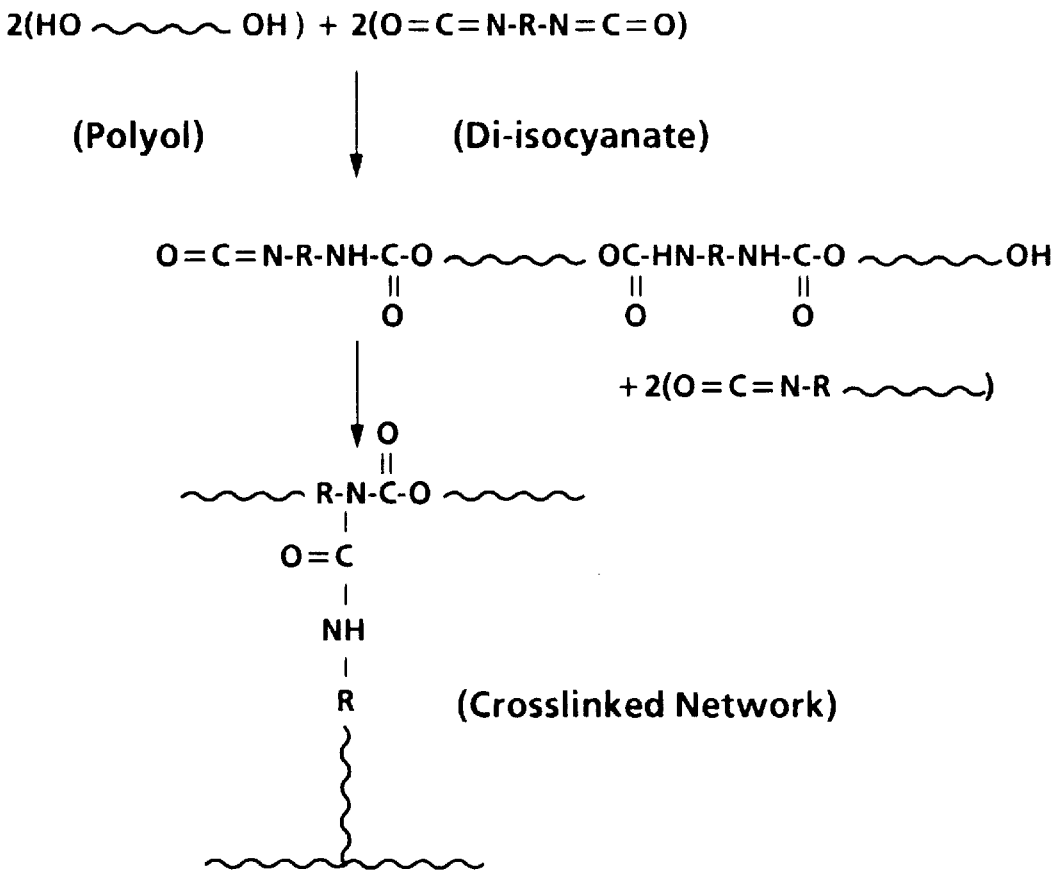
FIG. 2 is a diagram showing a chemical constituent of a crosslinked polyurethane network structure of an exemplary photoreceptor cleaning blade.

An elastomeric polyurethane cleaning blade was prepared by reacting liquid components of a prepolymer polyol (HO . . . OH) with a di-isocyanate crosslinker (O═C═N—R—N═C═O, where R is an aliphatic or aromatic functional) to form a crosslinked three-dimensional network elastomer. The crosslinking reaction, upon mixing the two liquid components, leads to the formation of a thermoset polyurethane elastomer, generally described as shown in FIG. 2.

EXAMPLE II

An elastomeric polyurethane cleaning blade was prepared in the same manner according to Example I, and was then impregnated with 1,3-Diphenylisobenzofuran. The presence of 1,3-Diphenylisobenzofuran in the cleaning blade material matrix imparted to the blade a capability of scavenging and neutralizing absorbed oxidizing agents of corona species emitted from any charging device(s) during photoelectrical imaging and cleaning processes, thus eliminating the corona species photoreceptor attack problem altogether. To achieve this purpose, a polyurethane blade weighing 12.3132 gms was submersed in a 0.00128 weight percent of 1,3-Diphenylisobenzofuran/methylene chloride solution (prepared by dissolving 0.041 gm of 1,3-Diphenylisobenzofuran in 3,180 gms of methylene chloride), and permitted to absorb the solution. The antioxidant used, 1,3-Diphenylisobenzofuran, was a finely divided yellowish powder and having the unique molecular structure shown in FIG. 3, and was obtained from Spectrum Chemical Manufacturing Corporation, a division of Janssen Chimica.

When a polyurethane blade is placed in contact with the thermodynamically strong solvent methylene chloride, it will continuously absorb the solvent, as well as the dissolved antioxidant, until the increase in elastic free energy due to the three dimensional isotropic expansion of the polyurethane network was offset by (or balanced with) the decrease in free energy due to mixing of polymer chain and this solvent, such that the condition of swelling equilibrium was reached. At this swelling equilibrium state, the swollen polyurethane blade (at 39.2101 gms) was removed from the solution and then allowed to deswell and dry at room ambient for at least 10 hours. The polyurethane blade was further dried under vacuum for 3 hours to remove trace amounts of methylene chloride. In that the antioxidant was nonvolatile, it thus remained permanently in the material matrix of the blade. The total amount (by weight percent) of antioxidant impregnated in the blade after the swelling/deswelling process was determined, by multiplying the weight percent of antioxidant concentration in solution by the total amount (weight) of solution absorbed into the blade at swelling equilibrium state and then dividing that by the weight of the original dry blade, as follows:

Percent antioxidant =
(0.00128%) (39.2101 gms − 12.3132 gms)/12.3132 gms = 0.0028%

To achieve satisfactory antioxidant impregnation results according to Example II, a desirable range of antioxidant in the cleaning blade may be within the range of about 0.0001 weight percent to about 5 weight percent. (A loading level below 0.0001 weight percent will diminish the effectiveness of the antioxidant, while a level greater than 5 weight percent may alter the mechanical properties of the blade.) A preferred loading level may range from about 0.001 weight percent to about 2 weight percent, while, as discussed in Example II above, an optimum level should be from about 0.002 weight percent to about 1 weight percent. (In other embodiments in which, for example, mechanical properties of a blade, brush or other device are not an issue or are not affected by antioxidant/antiozonant addition, far higher levels of antioxidant/antiozonant such as up to 15% or more may be quite useful if not desired..

EXAMPLE III

An elastomeric polyurethane cleaning blade was prepared in the same manner according to Example I, with the exception that the 1,3-Diphenylisobenzofuran dissolved in the methylene chloride was replaced by N-Phenyl-2-naphthylamine, available from Anchor Chemicals as a finely divided brownish colored powder; the resulting cleaning blade was impregnated to contain three times the concentration as that of 1,3-Diphenylisobenzofuran.

Although the exemplary experimental demonstrations outlined in Examples 2 and 3 above focus on 1,3-Diphenylisobenzofuran and N-Phenyl-2-naphthylamine, other antioxidants or antiozonants may also or alternatively employed, such as, for example: 2-tert-Butyl-4-methyl phenol; 2-tert-Butyl-5-methyl phenol; 2-tert-Butyl-6-methyl phenol; 2,6-Di-tert-Butyl-4-methyl phenol; 1,4-Diamino naphthalene; Phenylene diamine; Alpha tecopherol; N-tert-Butyl-α-phenylnitrone; EDTA; N,N'-Di-β-Naphthyl-P-phenylenediamine; 2,2'-methylene bis(4-methyl-6-tert butyl phenol); N,N'-Diphenyl-p-phenylenediamine; mono-octyl Diphenylamine; dioctyl Diphenylamine; mononony Diphenylamine; dinonyl Diphenylamine; 4-isopropoxy diphenylamine; N,N'-di-β-Naphthyl-p-phenylenediamine; N-Phenyl-β-naphthylamine; N-Phenyl-α-naphthylamine; N-cyclohexyl-N'-phenyl-p-phenylenediamine; and/or others. While impregnation of cleaning blades is described above as being completed after production of the blades (Example 1 and 2), similar results may likewise be obtained by including antioxidants in the blade as part of the initial manufacturing/fabrication process according to other methods

EXAMPLE IV

The polyurethane cleaning blade of Examples I, II, and III were each tested in extended duration trials in a xerographic printer/copier. The standard testing procedures included a total daily copy volume of 800 to 1000 copies per day. At the beginning and end of each day a 30% solid area coverage halftone pattern was made to observe the condition of the photoreceptor with respect to cleaning blade lines. The test environment was lab ambient and allowed to fluctuate through a normal office daily cycle of approximately 68-F/40% RH to approximately 75-F/50% RH. The untreated blade of Example I was again seen to cause the development of a band of print defect in copies corresponding to the location where blade make idle contact after only 2,000 prints. By contrast, the antioxidant impregnated blades of both Examples II and III showed no noticeable print defects after reaching an exemplary photoreceptor target life of 18,000 prints, thus demonstrating the total effectiveness of the present invention approach to eliminate the problem. Very importantly, the presence of antioxidant in the blade did not affect the blade cleaning efficiency, and specifically, did not change the Young's modulus, hardness, flexibility, and dynamic mechanical properties of these blades.

In recapitulation, various embodiments of a photoreceptor or intermediate transfer drum/roller cleaning system employing an antioxidant impregnated/treated cleaning blade or brush which permits the removal of residual toner and debris from the charge retentive surface of a photoreceptor has been described. Further, a system for providing and/or preparing a variety of devices (such as a bias transfer rolls, cleaning housings or other member) proximate to or in periodic or continuous contact with a photoreceptor or intermediate transfer member to prevent those devices from contibuting to corona species or other ozone-related outgassing attacks on photoreceptor or intermediate transfer member has also been described.

While the present invention has been illustrated and described in detail in the drawings and foregoing description, the same is to be considered as illustrative and not restrictive in character, it being understood that only the preferred embodiments have been shown and described and that all changes and modifications that fall within the spirit of the invention are desired to be protected.

I claim:

1. A system for preventing damage to a surface, comprising:

a member including at least a first portion thereof proximate to the surface; and an antiozonant for neutralizing ozonant agents present at the first portion of the members;

said antiozonant comprises a material selected from the group consisting of: ethylene diamine terta acetic acid; N,N'-Di-β-Naphthyl-P-phenylenediamine; 2,2'-methylene bis(4-methyl-6tert butyl phenol); N,N'-Diphenyl-p-phenylenediamine; mono-octyl Diphenylamine; dioctyl Diphenylamine; mononony Diphenylamine; dinonyl Diphenylamine; 4-isopropoxy diphenylamine; N,N'-di-β-Naphthyl-p-phenylenediamine; N-Phenyl-β-naphthylamine; N-Phenyl-α-naphthylamine; and N-cyclohexyl-N-cyclohexyl-N'-phenyl-p-phenylenediamine.

2. The apparatus of claim 1, wherein said antiozonant is impregnated in the member utilizing a solvent.

3. The apparatus of claim 1, wherein said antiozonant is impregnated in the first portion of the member.

4. The apparatus of claim 1, wherein the surface is electrical charge retentive.

5. The apparatus of claim 4, wherein the member is a cleaning blade for cleaning the charge retentive surface and wherein the first portion contacts the charge retentive surface.

6. The apparatus of claim 4, wherein the member is a cleaning brush for cleaning the charge retentive surface and wherein the first portion contacts the charge retentive surface.

7. The apparatus of claim 1, wherein the first portion of the member comprises a swellable material.

8. The apparatus of claim 1, wherein the first portion of the member comprises a polymeric material.

9. The apparatus of claim 1, wherein said antiozonant is impregnated in the member in an amount, by percent weight of said member, ranging from about 0.0001% to about 15%.

10. A printing machine including a system for preventing damage to a charge retentive surface, comprising:

a member including at least a first portion thereof proximate to the charge retentive surface; and an antiozonant for neutralizing ozonant agents present at the first portion of the member;

said antiozonant comprises a material selected from the group consisting of: ethylene diamine terta acetic acid; N,N'-Di-β-Naphthyl-P-phenylenediamine; 2,2'-methylene bis(4-methyl-6-tert butyl phenol); N,N'-Diphenyl-p-phenylenediamine; mono-octyl Diphenylamine; dioctyl Diphenylamine; mononononyl Diphenylamine; dinonyl Diphenylamine; 4-isopropoxy diphenylamine; N,N'-di-β-Naphthyl-p-phenylenediamine; N-Phenyl- β-naphthylamine; N-Phenyl-α-naphthylamine; and N-cyclohexyl-N'-phenyl-p-phenylenediamine.

11. The printing machine apparatus of claim 10, wherein said antiozonant is impregnated in the member utilizing a solvent.

12. The printing machine of claim 10, wherein said antiozonant is impregnated in the first portion of the member.

13. The printing machine of claim 10, wherein the member is a cleaning blade for cleaning the charge retentive surface and wherein the first portion contacts the charge retentive surface.

14. The printing machine of claim 10, wherein the member is a cleaning brush for cleaning the charge retentive surface and wherein the first portion contacts the charge retentive surface.

15. The printing machine of claim 10, wherein the first portion of the member comprises a swellable material.

16. The printing machine of claim 1, wherein the first portion of the member comprises a polymeric material.

17. The printing machine of claim 10, wherein said antiozonant is impregnated in an amount, by percent weight of said member, ranging from about 0.001% to about 15%.

18. The printing machine of claim 10, wherein said antiozonant is impregnated in an amount, by percent weight of said member, ranging from about 0.001% to about 5%.

19. The printing machine of claim 10, wherein said antiozonant is impregnated in an amount, by percent weight of said member, of about 0.0028%.

20. A method for neutralizing ozonants on members proximate to charge-retentive surfaces in a printing system, comprising:

providing an antiozonant material; and treating at least a first portion of the member adjacent to the charge-retentive surface with said antiozonant for neutralizing ozonant agents present at the first portion of the member;

said antiozonant material comprises a material selected from the group consisting of: ethylene diamine terta acetic acid; N,N'-Di-β-Naphthyl-P-phenylenediamine; 2,2'-methylene bis(4-methyl-6-tert butyl phenol); N,N'-Diphenyl-p-phenylenediamine; mono-octyl Diphenylamine; dioctyl Diphenylamine; mononononyl Diphenylamine; dinonyl Diphenylamine; 4-isopropoxy diphenylamine; N,N'-di-β-Naphthyl-p-phenylenediamine; N-Phenyl-β-naphthylamine; N-Phenyl-α-naphthylamine; and N-cyclohexyl-N'-phenyl-p-phenylenediamine.

21. The method of claim 20, wherein said treatment comprises impregnating the member by swelling the member with an antiozonant containing solvent.

22. The method of claim 20, wherein the member is a cleaning blade for cleaning the charge retentive surface and wherein the first portion contacts the charge retentive surface.

23. The method of claim 20, wherein the member is a cleaning brush for cleaning the charge retentive surface and wherein the first portion contacts the charge retentive surface.

24. The method of claim 20, wherein the first portion of the member comprises a polymeric material.

25. The method of claim 20, wherein said antiozonant is impregnated in the member in an amount, by percent weight of said member, ranging from about 0.0001% to about 15%.

* * * * *